US007090114B1

(12) United States Patent
Katz

(10) Patent No.: US 7,090,114 B1
(45) Date of Patent: Aug. 15, 2006

(54) INLINE MANUFACTURED CROSSFOLD PACKAGE AND METHOD

(76) Inventor: Robert E. Katz, 16 Elkins Rd., East Brunswick, NJ (US) 08816

( * ) Notice: Subject to any disclaimer, the term of this patent is extended or adjusted under 35 U.S.C. 154(b) by 0 days.

(21) Appl. No.: 10/624,898

(22) Filed: Jul. 23, 2003

Related U.S. Application Data

(63) Continuation-in-part of application No. 10/158,149, filed on May 31, 2002, now Pat. No. 6,865,864.

(51) Int. Cl.
*B42D 15/00* (2006.01)

(52) U.S. Cl. ..... 229/92.8; 229/92

(58) Field of Classification Search ..... 229/92.8, 229/92–92.3, 80.5
See application file for complete search history.

(56) References Cited

U.S. PATENT DOCUMENTS 576,552 A * 2/1897 Cook ..... 229/92.1
2,037,420 A * 4/1936 Lindgren ..... 229/80
2,074,821 A * 3/1937 Wissmann ..... 229/92.1
2,168,920 A * 8/1939 Wissmann ..... 229/92.8
2,249,260 A * 7/1941 Sohl ..... 229/92.1
3,159,329 A * 12/1964 Hiersteiner ..... 229/68.1
3,197,121 A * 7/1965 Hayes, Jr. ..... 229/92.1
3,352,481 A * 11/1967 Kirchof ..... 229/92.1
3,579,947 A 5/1971 Kalman
3,580,490 A * 5/1971 Shaad ..... 229/92.9
3,618,284 A 11/1971 Gendron
3,665,817 A 5/1972 Katz et al.
3,784,185 A 1/1974 Katz
3,808,768 A 5/1974 Dobbs
3,837,565 A * 9/1974 Johnsen ..... 229/301
4,012,268 A 3/1977 Johnsen
4,199,630 A * 4/1980 Consiglio ..... 428/43
4,205,504 A 6/1980 Gregoire et al.
4,312,169 A 1/1982 Golicz et al.
4,342,418 A * 8/1982 Meschi ..... 229/92.1
4,380,315 A * 4/1983 Steidinger ..... 229/69
4,464,878 A 8/1984 Golicz et al.
4,726,802 A 2/1988 Volk, Jr.
4,852,795 A 8/1989 Volk, Jr.
4,931,035 A 6/1990 Schmidt
4,939,888 A 7/1990 Katz et al.
5,197,262 A 3/1993 Katz et al.
5,360,159 A * 11/1994 Perriman ..... 229/92.3
5,375,763 A * 12/1994 Sauerwine ..... 229/303
5,398,867 A * 3/1995 Murphy ..... 229/69
6,073,421 A 6/2000 Lee
6,627,033 B1 * 9/2003 Dexter ..... 156/260

* cited by examiner

*Primary Examiner*—Jes F. Pascua
(74) *Attorney, Agent, or Firm*—Shlesinger, Arkwright & Garvey LLP

(57) ABSTRACT

Inline crossfold product and method that will provide substantially more insert sheet material than previous inline crossfold methods, and, additional inline crossfold packet configurations, is provided. A bound crossfold booklet, the equivalent of or a small catalog, which is particularly adapted for large mail distribution is provided. The substantially lower mailing cost of a six by nine inch booklet size, instead of the ordinary letter size catalog, yields substantial savings. Production and handling costs are also minimized since the booklets are bound in the inline process, thereby eliminating separate handling and binding costs, where there is a separate binding and envelope stuffing operation required.

14 Claims, 9 Drawing Sheets

INLINE MANUFACTURED CROSSFOLD PACKAGE AND METHOD

This application is a continuation-in-part of U.S. patent application Ser. No. 10/158,149 filed on May 31, 2002 now U.S. Pat. No. 6,865,864.

FIELD OF INVENTION

This invention relates to inline printed and manufactured mailing and advertising items, and particularly to a new type of low cost, inline manufactured crossfold packet and the method of manufacturing it.

BACKGROUND OF THE INVENTION

Inline printing and manufacture is used for making low cost large volume advertising items, particularly bulk mail pre-addressed envelopes, termed mailers, which contain advertising and solicitation material.

Inline manufacture involves printing a web and subsequently performing a number of successive high speed inline processing operations on it, to obtain the intended format and configuration of the final printed item.

The first operation is the printing of an envelope and advertising format on a continuous web, within each of a succession of identical printed half repeat sections. Typically, a full repeat section is printed with each revolution of a printing press cylinder.

Subsequent operations include applying a pattern of adhesive to the envelope (outer wrap) panels, in each half repeat; adding personalized printing to each successive half repeat section; longitudinally folding the ribboned or folded advertising section of the web, or slitting it into independent ribbons which are then superposed and combined; and, then packaging the printed advertising pieces by longitudinally folding the envelope portion of the web over the advertising material to form envelope packets; and separating, from the web, the formed envelope packets.

These operations result in an envelope item, containing printed advertising, produced in one continuous economical operation, ready for mailing. Two identical advertising mailers, in two half repeats, are printed on the flat web surface with each rotation of the printing cylinder.

In the conventional inline process, each successive printed one-half repeat or less of the printed web, is the web area limit usable for inline processing. Ordinary inline mailer advertising pieces are usually typical envelope size items having a panel width of four inches and a length of nine inches. This typical letter size envelope limits the size of insert advertising panels, to a smaller size panel and less effective advertising presentation, than the maximum envelope size mailer having a six inch width. But, the six inch width envelope allows for only four advertising insert panels, in a one half repeat, even with the large thirty-six inch inline printing cylinder.

Since the inline production process is limited to only a longitudinal folding of the web, it consequently requires two outer wrap envelope panels to be printed side by side in a single one half repeat section of the web.

The new type packet, produced by an inline crossfold method, the subject of my co-pending parent application, is not confined to the one-half repeat printing area of the web, and is not limited to longitudinal folding. It recognizes that a crossfold operation can be made as a final step, using a modified signature printing press folder unit used with large printing press equipment. This permits use of a full repeat, if the printed envelope panel configuration is changed, to position the envelope panels end to end in adjacent half repeats. The inline crossfold process introduced to inline printing and fabrication, the ability to produce a finished piece having twice the amount of printed advertisement panels.

Although the inline crossfold method substantially increased advertising insert contents and market for inline products, it is limited to a paper content of one repeat.

SUMMARY OF INVENTION

The present invention is directed to an inline crossfold product and method that will provide substantially more insert sheet material than my previous inline crossfold method, and, additional inline crossfold packet configurations.

The invention provides for a bound crossfold booklet, the equivalent of or a small catalog, which is particularly adapted for large mail distribution. The substantially lower mailing cost of a six by nine inch booklet size, instead of the ordinary letter size catalog, is a substantial saving. Production and handling costs are also minimized since the booklets are bound in the inline process, thereby eliminating separate handling and binding costs, where there is a separate binding and envelope stuffing operation required.

The additional insert sheet material for the envelope supplied by correlating a second inline processed insert printed web with the insert material of the initial first web.

A completely sealed package is also possible with a pre-packaging cutting of the insert pieces, before they are wrapped with the envelope panels, so that they are of less length, and will allow for closure along their end.

New inline crossfold envelope configurations are readily opened by the addressee, and they also provide convenient customer order and return mailing features.

These and other features add advantages of this invention will become apparent from the following description of the invention.

DESCRIPTION OF THE INVENTION

Figure 1:
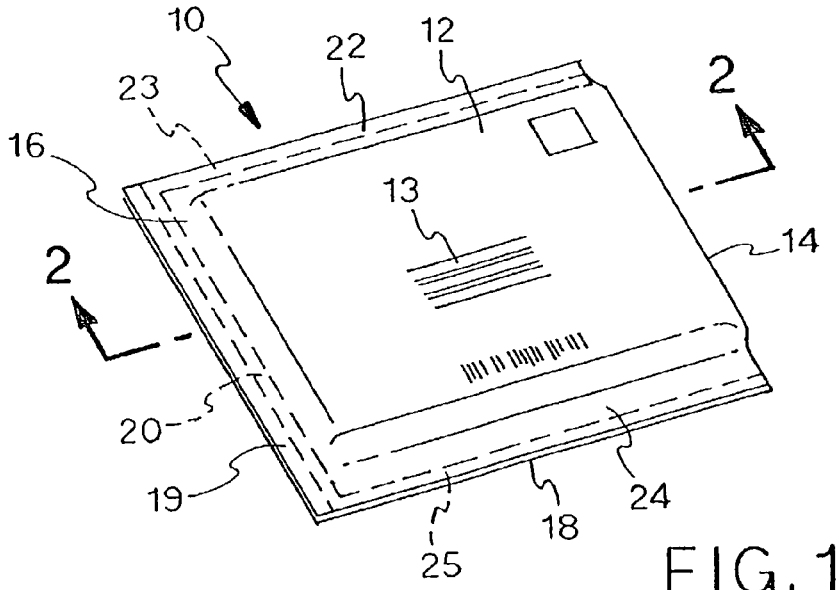
FIG. 1 is a perspective view of a closed mailer packet.
Figure 2:
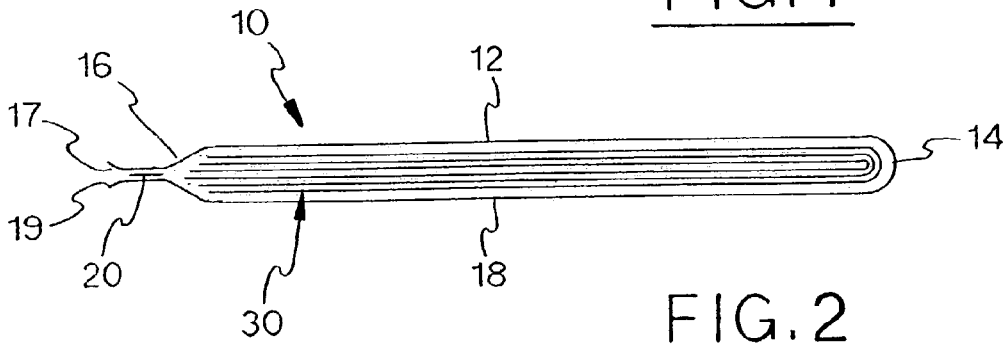
FIG. 2 is a cross sectional view of the packet of FIG. 1.
Figure 3:
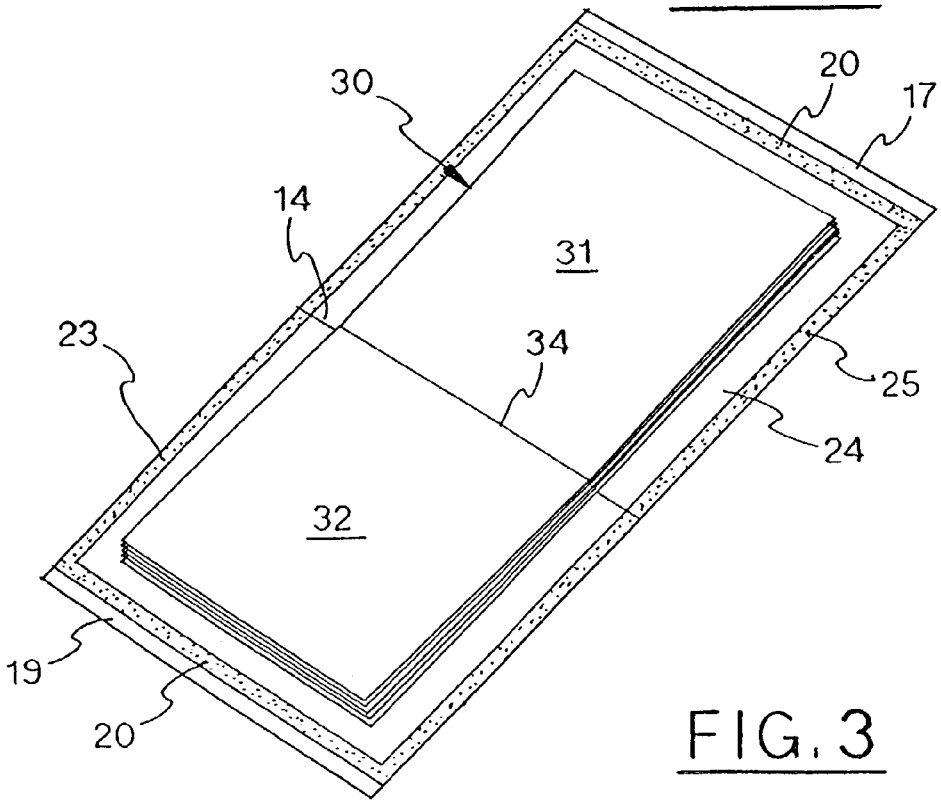
FIG. 3 is a plan view of the opened packet of FIG. 1.

The packet shown in FIGS. 1 through 3 completely encloses a multi-page insert which is supplemented by material from a second web.

FIG. 1 is a perspective view of a mailing advertising packet 10, taken from one of the printed successive full repeats. It has an outer wrap address panel 12 which has a printed address 13 of the addressee. The right folded and closed side 14 is coincident with the printed one-half repeat line of the repeat. This end of the inline crossfold packet is transversely folded along the half repeat line by the modified publication folder unit.

Cross-sectional view, FIG. 2 shows the opposite openable side 16 which has an extended gripping section 17, disposed opposite a corresponding gripping section 19 of the lower back outer wrap envelope panel 18. A line of self seal releasable pressure contact adhesive strip 20, such as latex, is disposed between the extended gripping sections 17 and 19 inwardly of the panel outer edges to close that side of the packet 10. The gripping sections 17 and 19 are pulled apart to open the packet. The sides 22 and 24 of the packet 10 are sealed by releasable self seal pressure releasable contact adhesive strips 23 and 25 disposed along the side edges on the inside surface of the outer wrap envelope address and back panels 12 and 18 to completely close the packet 10.

As shown in the packet cross section of FIG. 2, the outer edge sections of extended sections 17 and 19 are not held together by the adhesive 20. These edges are sufficiently wide to permit the package to be grasped between fingertips and then pulled apart. The releasable adhesive allows the wrap panel side to part when the two extended sections are pulled apart.

The multi-sheet folded insert generally indicated at 30 in FIGS. 2 and 3 has many sheets which form a folded booklet. As shown in the open perspective view of the packet 10 in FIG. 3, the upper center page 31 and its underlying pages are folded over the lower center page 32, and its underlying pages, along the fold line 34. Fold line 34 is the half repeat line for these pages, and is coincident with the fold line 14 of the outer wrap.

As shown in the cross sectional view of the FIG. 2, as well as the perspective view of FIG. 1, the packet 10 is relatively thick because of the number of additional sheets added to the insert 30, by a full repeat of a second printed web. It will be noted that as a result of the folding of many insert sheets along line 34, the free extended edges of the insert pages (as much as 25), have a tapered configuration adjacent the adhesive 20, and wrap panel openable end sections 17 and 19. This taper adjacent the insert end section will reduce the tendency of the thick insert to separate the adhesive strip 20 holding the extended wrap sections 17 and 19 together.

Figure 4:
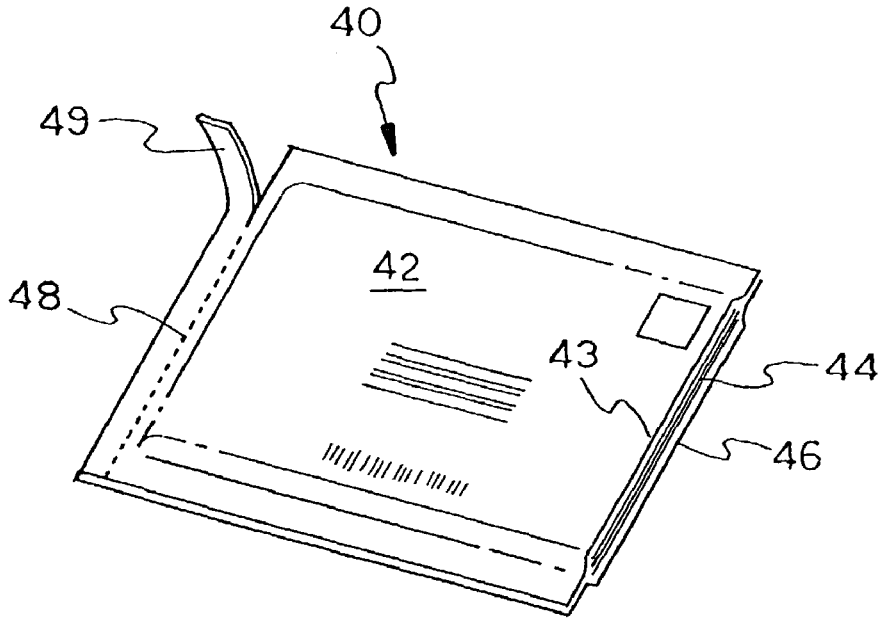
FIG. 4 is a perspective view of a packet having a trimmed end for providing individual rectangular insert sheets, and also showing a tear off opening section.

The perspective-view of FIG. 4 shows two variations that can be made to the closed end packet of FIG. 1. The packet 40 and its outer wrap envelope address panel 42 has both its folded end cut off at 43, adjacent to the fold line. And, also, the folded portion of the insert material, (not shown) along line 44, and the end of the back outer wrap envelope panel at 46. This cut-off packet will then have a plurality of individual and separate rectangular insert pieces. The packet will then have one side of the packet 40 open to permit the packet to be fully pulled open and the insert pieces removed.

Additionally, it is possible to modify the advertising packet 10 of FIG. 1 at the openable end, by substituting, as shown in FIG. 4, a perforated line 48 cutting through the wrap panels, inside of the adhesive. The line of perforations extends through both the outer wrap address panel 42 and the back outer wrap panel. The perforate line 48 is disposed between the end of the insert material and the line of adhesive (not shown) adjacent the outer edges of the wrap panel. This provides a tear off strip 49 which opens the packet when the tear off strip is removed.

Figure 5:
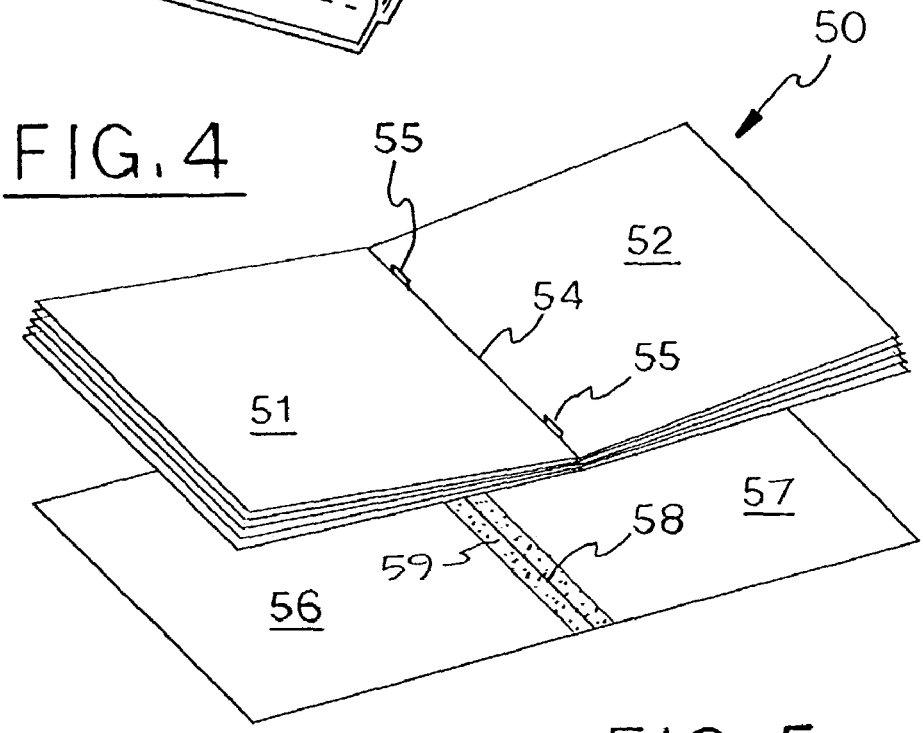
FIG. 5 is a perspective view of a fold line stapled multi-page booklet and an outer cover.

FIG. 5 shows a perspective view of a modified insert booklet 50 which can be incorporated in the packet, in the same fashion as shown in FIG. 3 for the folded booklet 30. The folded booklet 50 of FIG. 5 has plurality of superposed sheet such as 51 and 52 which are folded about the half repeat line 54. These sheets are stapled together by staples 55 positioned on the fold line 54. The lowermost sheet has panels 56 and 57 folded about the half repeat fold line 58, which contacts the adhesive strip 59. The lower sheet provides outer backing for the booklet and covers the exposed staples 55.

With inline processing it is possible to make changes in configuration of the closed packet, very simply, without requiring substantial changes in fabricating equipment. The inline processing for producing the packet of the foregoing figures and other variations, is shown diagramatically in FIG. 6.

A large rotatably mounted roll of print paper 60 feeds a web 61 through a printing press 62, where a series of successive repeat panels are printed. In this invention, a portion of these printed repeats includes end to end rectangular outer wrap address and back panels, which form the envelope, each panel extending one half repeat length of the repeat along an edge of the web. The remainder of the repeat panels of the web 61 is usable for printing of the insert material. The insert portion of the web 61*b* is split off from the wrap ribbon 61*a*, at 63, and combined with the insert ribbons in a second web 71.

The outer wrap ribbon 61*a*, after the split-off of the insert portion 61*b*, is a continuing ribbon of successive repeats the width of the wrap panels. Releasable self seal contact adhesive, such as latex, is applied to the under surface of the section of the repeat having the outer wrap panels, at 64. The glue pattern can be varied to apply adhesive strips along the edges of the inner surface of the wrap address and back panels (i.e., the under surface), or only the transverse edges of the wrap panels, or both, by changing the pattern of the roller assembly 64 applying the adhesive to the web.

Figure 13:
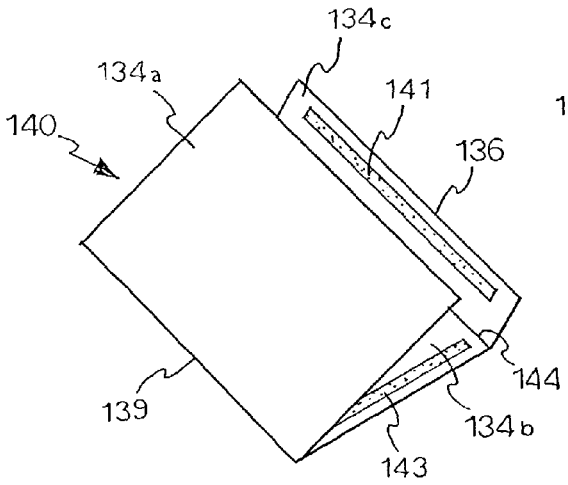
FIG. 13 shows a partially folded return envelope from the format of FIG. 12.
Figure 12:
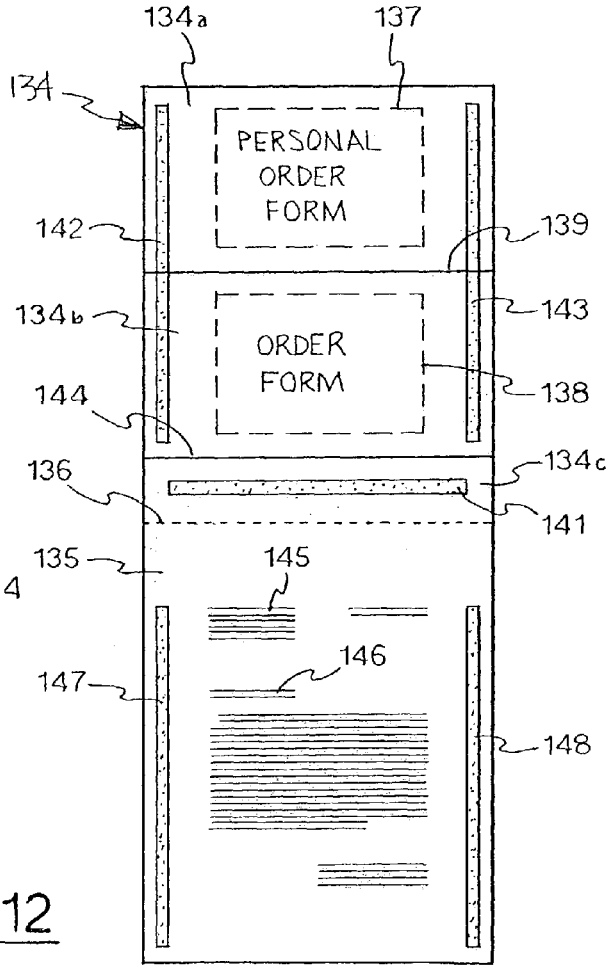
FIG. 12 is a plan view of the outer wrap of FIG. 11 showing the return envelope format on the inner surface.

Remoist glue is applied by the applicator and roller assembly 64*a*, for placing a transverse glue strip on the outer flap of a return envelope configuration (see FIGS. 12 and 13). The latex adhesive and the remoist glue are dried, as the wrap ribbon passes through the drying oven 65. The ink jet imager 66 applies the successive different mailing addresses of the intended recipients, to the upper and outer surface of the printed outer wrap envelope address panels, for all of the succeeding full repeats of the web. The die punch 67 cuts out the flap for the open envelope of FIG. 14. The perforating assembly 68 makes a transverse perforate line across each of the outer ends of the outer wrap panels immediately adjacent each end of their repeat to form the tear off strip 49 of the FIG. 4 configuration.

All of the processing steps, subsequent to the web 61 passing through the printing press 62 are applied to the separated outer wrap ribbon 61*a* which has been separated from the main web, immediately after printing at 63.

The separated section of the web 61*b* is an insert section which is either separated into successive superposed ribbons or a multi-folded configuration (not shown), which are then combined with a ribboned or folded second independent printed web 71 from the roll 70. The superposed insert ribbons 61*b* of the first web 61, are brought into position through a turn bar assembly (not shown), underneath and in superposed relation with the superposed insert ribbons from the second web 71*a* to supplement the insert material of web 71. The processing and ribboning of the insert section of web 61 is similar to that of web 71. For simplicity of illustration, processing of this insert ribbon group from web 61 is only shown as line 61*b*.

The separate insert web 71 from roll 70 is printed by press 72, having the same repeat length as the outer wrap. Web 71 then passes under an ink jet imager 73, which is correlated with address panel imager 66, to provide matched outer wrap address and insert addressee data. Web 71 is separated into ribbons, for a multi-longitudinally folded configuration, and placed in superposed position by the slit and fold stages, schematically shown at 74. These operations produce a plurality of superposed insert ribbons, or a common fold ribbon 71*a*.

The ribbons then pass under a staple-stitching assembly 75 which staples the ribbons together along their half repeat line, to bind them into a booklet, if such a configuration is desired.

The superposed insert ribbons, or longitudinally folded insert, form insert web 71*a* which then passes through compensating roller assembly 76. The assembly 76 is manually adjustable to lengthen or shorten the length of web travel. This adjustment keeps the insert web 71*a* in registration with ribbon 61*a* and the cross folder assembly 82, 83. It is essential that the folder unit make the fold, for both envelope ribbon 61*a* and the insert web 71*a* simultaneously, exactly on the half repeat line of the insert.

Rotary cutter 77 removes small transverse sections of the superposed insert ribbons at each end of the full repeat line to separate the web into a successive series of independent sets of superposed shortened sets of inserts, In. The insert In are shorter than the outer wrap panels, to allow space for the self sealed adhesive strips and closure around the end of the insert pieces.

The processed outer wrap ribbon 61*a*, holds the inserts In in position as they both move to the folder unit 82, 83. The outer wrap ribbon passes over and around the roller 69 and downwardly past a manually adjustable movable compensating roller assembly 69*a* which adjusts the length of travel of the wrap for registering the wrap with the insert web 71*b*. This adjustment also acts to keep the registration of the one half repeat line of the outer wrap ribbon 61*a* in synchronization with the half repeat line of composite web 71*a* and the composite insert pieces, In, passing through cutter 77*a*.

The severed and shortened composite insert pieces, In, then are carried on a conveyor (not shown), and under roller 78, and the continuous outer wrap ribbon 61*a*. The outer wrap ribbon 61*a* and the successive matching insert pieces, In, in registration, are then simultaneously passed over the roller 80 and through nip stapler unit 81. Stapler 81 is used to join outer wrap and inserts together at their common half repeat fold line, when that is desired.

The combined wrap web and inserts then pass to the modified publication folder assembly 82 and 83. The publication folder assembly folds the outer wrap 61*a* over the set of shortened inserts, along their common synchronized half repeat fold lines. In this operation, the outer wrap, and its corresponding insert are simultaneously folded along their commonly aligned half repeat lines. Each folded packet assembly is then cut off from the end of the composite wrap and insert web, to produce the individual packets generally shown at 84. The outer wrap address panel and the corresponding back panel thereby provide an envelope for the folded insert where the fold line forms one end of the completed packet.

The compression rollers 85 press the outer wrap panel adhesive surfaces together, along the side edges. The rollers 86 press the end adhesive surfaces of the wrap panels together, to close the ends of the packet. The perforating drum 87 cuts the perforate line 228 for the tear off strip of FIG. 20. Perforating drum 68 cuts perforate line 136 to permit removal of the FIG. 12 letter form from the return order blank printed on the inner side of the outer wrap.

The control of the rotation of the folder cylinders 82, 83 of the folder unit is mechanically controlled by direct mechanical connection 88 to the operating machinery of the printing press 72 which controls the printing and moving the printed web. It should be noted that the folder cylinder circumference may be equal to the repeat length.

Small adjustments, when necessary, are made by the ribbon adjusting assemblies 69*a* and 76, to ensure that each successive fold operation of the modified publication folder, folds along the superposed half repeat line of each set of the superposed wrap panels and their associated insert pieces. Registration must be maintained within close tolerances, about 30 thousandths, of the actual half repeat line of the two incoming composite insert pieces and the wrap ribbon.

The cutter blade 77*a* of the cutter 77 can be adjusted manually for changes in registration, by adjusting the mechanical differential assembly D connected to the mechanical power line 89. The power shaft 88, is directly connected to the cutter through power line 89 and Differential D. The power shaft 88 is thereby interconnected to the cutter 77, and cylinder 82 of the modified publication folder assembly.

The folder assembly elements containing cylinders 82 and 83 are part of a modified publication folder used with large printing presses used for printing and folding magazine type signatures. The publication folder assembly found in such presses is removed and a web control assembly (not shown) is added, to permit inline feed of the incoming ribbons to the folder unit. The folder assembly takes the end of the combined printed envelope and insert web elements and transversely folds them along the their half repeat line, enclosing them in a clam shell manner, with the insert sheet material In within the two connected ends of the outer wrap panels of ribbon 61*a*.

On folding, the releasable self seal contact adhesive, such as latex, previously applied at 64 to the under surface along the edges of each of the outer wrap panels, are pressed together to close and seal the envelope packet by the roller assemblies 84 and 86.

Figure 6:
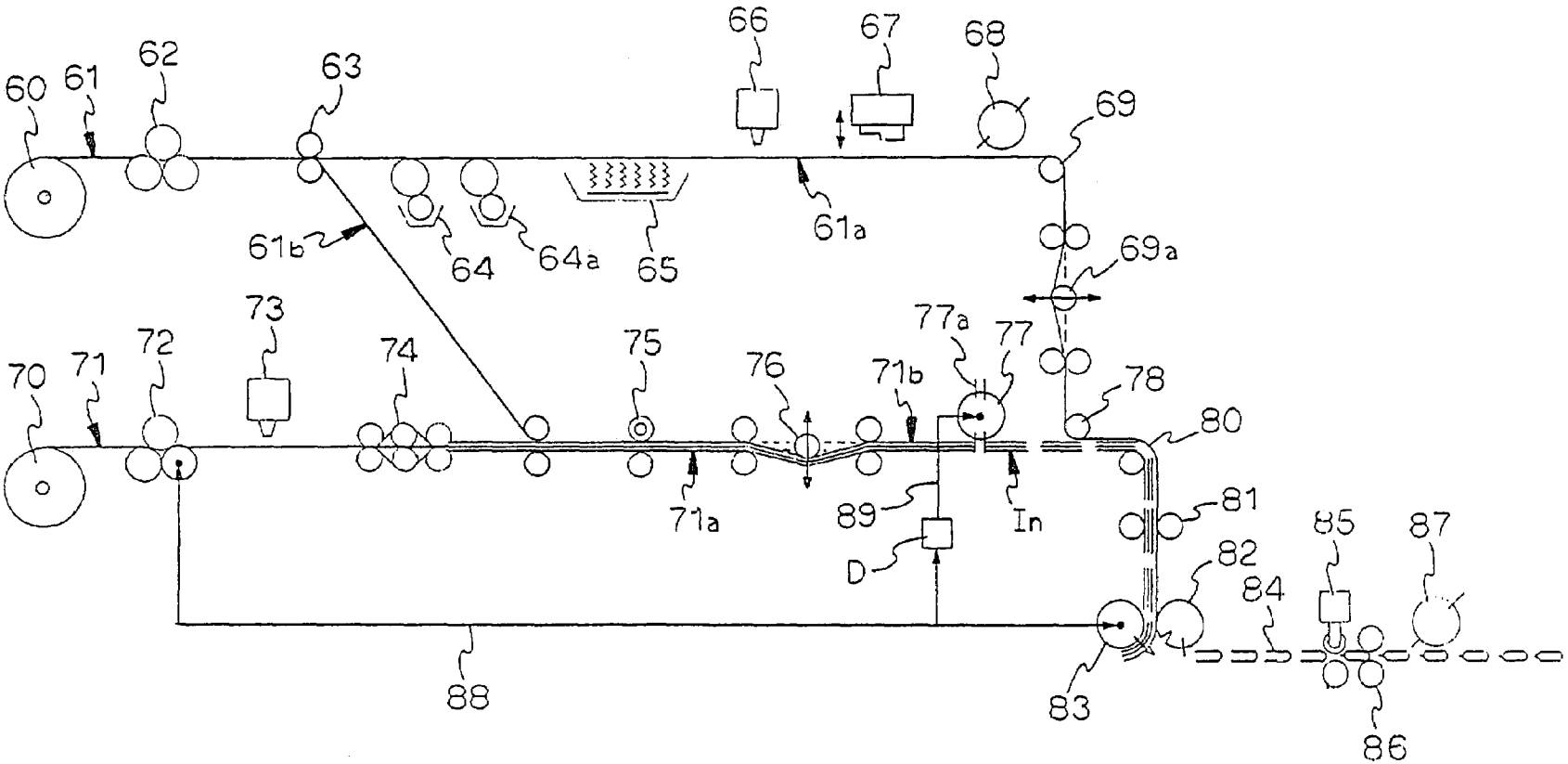
FIG. 6 is a diagram showing the inline processing and crossfold process for making the packet.
Figure 7:
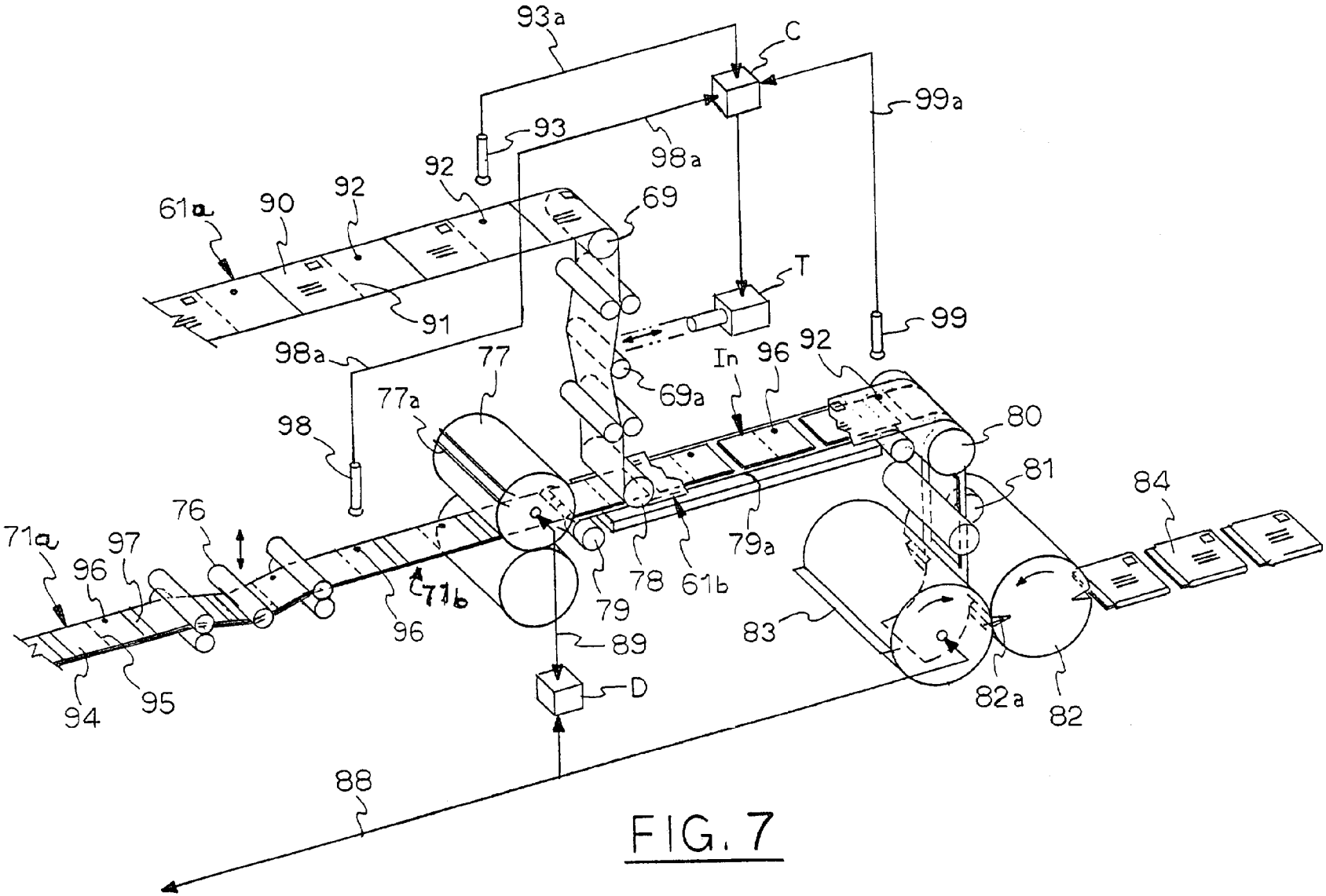
FIG. 7 is a schematic drawing of the synchronizing assembly for maintaining registration of the half repeat line of the combined web ribbons, and, of the modified publication folder.

FIG. 7 is a perspective view of a portion of the assembly of FIG. 6 showing in more detail the operational features, as well as an automatic electrical control that automatically synchronizes the half repeat lines of the wrap ribbon, and the composite packet inserts In.

The outer wrap ribbon 61*a* has successive repeats 90 each of which has a half repeat line 91. For registration purposes, a registration mark 92 is placed along the side edge of the ribbon to control positioning. A photoelectric scanner 93, is positioned directly over the line of travel of the successive registration marks 92, and sends an electrical output along line 93*a* to a photoelectric registration control unit C. A commercially available control unit is a Baldwin Manufacturing Company WPE Model 230-200. The scanner signal is obtained immediately before the outer wrap ribbon passes over the roller 69 and down into the ribbon adjusting section at 69*a*.

The relative speeds of the outer wrap ribbon 61*a* and the composite superposed insert ribbons 71*a* of web 71 are maintained by the machinery of the printing presses, which are operated at an identical uniform speed, of from 800 to 1,000 fpm. However, misalignment variations can occur, because of variations in paper stock, moisture content, and other factors, that will slightly displace the half repeat lines of the two webs that are to be joined. Accuracy to within thirty thousandths of an inch must be maintained, even though the webs are traveling at a speed of nearly one thousand feet per minute.

The superposed composite ribbons 71*a* of web 71, overlay added insert web 61*a*, joined underneath web 71(detail not shown) prior to the staple or stitching stage 79. Web 71 has successive repeats 94, that are aligned with the underlying ribbons, and a half repeat line 95. Successive control marks 96 are disposed along the side edge of the uppermost insert ribbon. The transverse cutout section 97 will remove a small piece from each side of the full repeat line on the ribbon. This removed piece will provide a shorter insert sheet group that will fit within the envelope, so that the adhesive at the ends of the outer wrap panels are outside the insert material.

Between the manually adjustable compensating roller 76 and the cutter 77, the electronic scanner 98 monitors the passage of the control mark 96, and transmits a steady signal along line 98*a* to the photo electronic registration control C. Electronic circuitry compares the succession of incoming signals to determine whether there is any relative displacement between them. Each of the marks 92 and 96 is placed in the same relative position on their respective repeats. The repeats for both webs are of identical length. If there is a change in signal, the output from the registration control C transmits an adjusting signal to the mechanical compensating roller assembly T. Registration of the outer wrap web is controlled by movement of the roller 69*a* through the reciprocating shaft of the compensating assembly T. The movement of the shaft will shorten or lengthen the travel of the outer wrap web 61*a* to adjust the relative position of the half repeat on the webs.

FIG. 7 also shows the manner in which the conveyor assembly 79 supports the insert pieces by a moveable belt 79*a*. The inserts are also held and moved from above by the outer wrap envelope web 61*b*, which passes under the retaining roller 78. The positioning mark 92 on the outer wrap web that passes under the electronic scanner 99, immediately before the composite passes over the roller 80, also passes the signal along line 99*a* for purposes of controlling the position of the outer wrap and the insert ribbons with respect to the folder tuck blade 83*a* and the receiving groove 82*a* on the folder cylinders 82 and 83. The fold must be made accurately on the aligned half repeat lines of the outer wrap and the insert. The output of the scanner 99 also controls this adjustment.

The completed and cutoff pieces are shown at 84 leaving the cylinders 82 and 83 of the publication folder unit.

This invention, using two printed webs having the same repeat length, which are accurately synchronized, and have been continuously adjusted for a registration of the half repeat lines with a modified publication folder, makes it possible to enclose the larger amount of insert material, and also to introduce different and varied format designs for the ultimate package, not possible with ordinary inline practices, or with the single web inline crossfold fold process disclosed in my previously filed parent application.

This unique inline processing, supplementing the single web inline crossfold capability, provides a bound catalog type booklet ready for mailing. The process makes it possible to completely enclose the insert, containing the material of two webs. The use of two different webs, also makes it possible to provide a high gloss heavy stock printing for the outer wrap web 61, for the envelope, as well as the cover of the booklet, and its center pages, as well as convenient reusable return envelope configurations.

Use of two outer wrap panels in an end-to-end connection at the half repeat line, in a clam shell envelope, has more than four times the number of insert piece capacity as the ordinary longitudinally folded inline envelope, and twice the insert piece capacity of my single inline crossfold process.

FIGS. 8 through 11 show variations of envelope configuration of an opened packet, containing a booklet.

Figure 8:
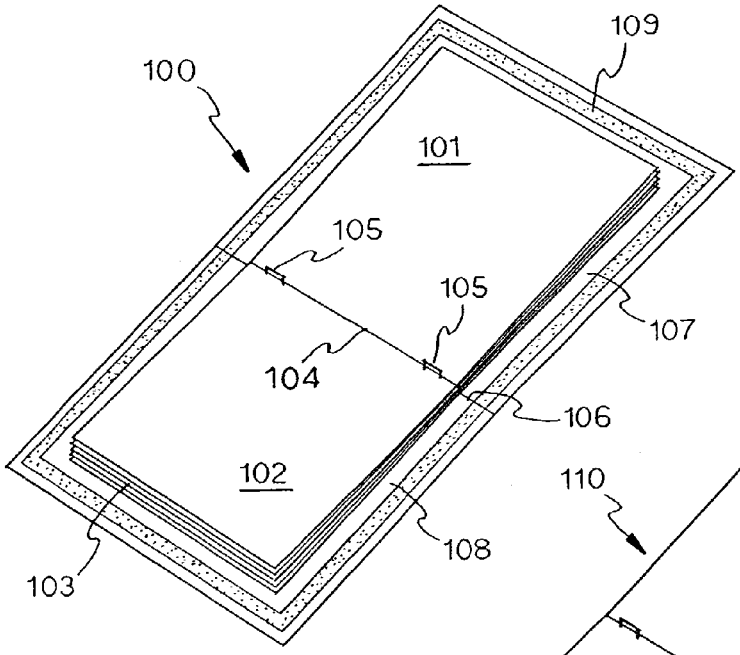
FIG. 8 is a plan view showing an opened packet containing an opened booklet which is fully enclosed by an outer wrap.

An opened completely sealed packet 100 shown after opening is shown in perspective in FIG. 8. A multiple page booklet carrying center pages 101 and 102 are folded about the insert booklet half repeat and fold line 104. The pages are held together by staples 105. The folded multi-page booklet, containing multiple advertising pages or other printed type of material, is then removed. It is a self contained booklet.

The packet 100 is folded along both the half repeat fold line 104 of the booklet, and the half repeat fold line 106 between the outer wrap panels 107 and 108. The booklet end edges 103 and the side edges are inside and clear of the peripheral self seal releasable contact adhesive strip 109 on the inner surface outer edges of the wrap panels 107 and 108.

A modified publication folder does this in a single operation on the incoming end of the composite web for both the inserts, such as the insert booklet, and the outer wrap, simultaneously. It is possible to staple or stitch the booklet sheets or pages together to form a booklet removable from the envelope, or, the staples 105 can be simultaneously applied to both the insert sheet and to the outer wrap by stitch assembly 81 if desired. Consequently, packet 100 provides a readily pulled-open, closed envelope packet mailer with a multiple sheet booklet having a stapled or stitched fold line, instead of the loose separate folded sheets of insert 30 of FIG. 3.

Figure 9:
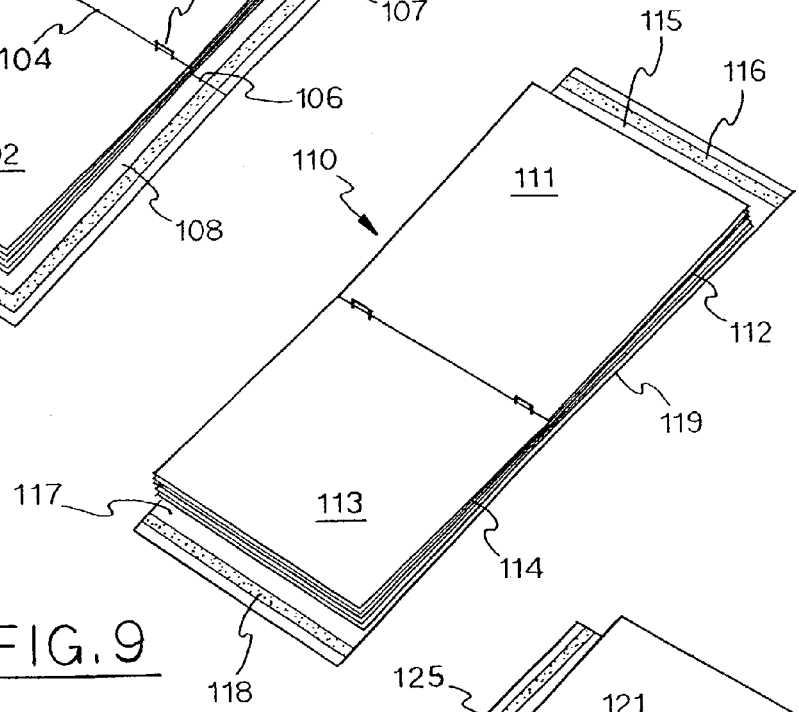
FIG. 9 is a plan view showing an opened packet having open sides which contains an open booklet.
Figure 10:
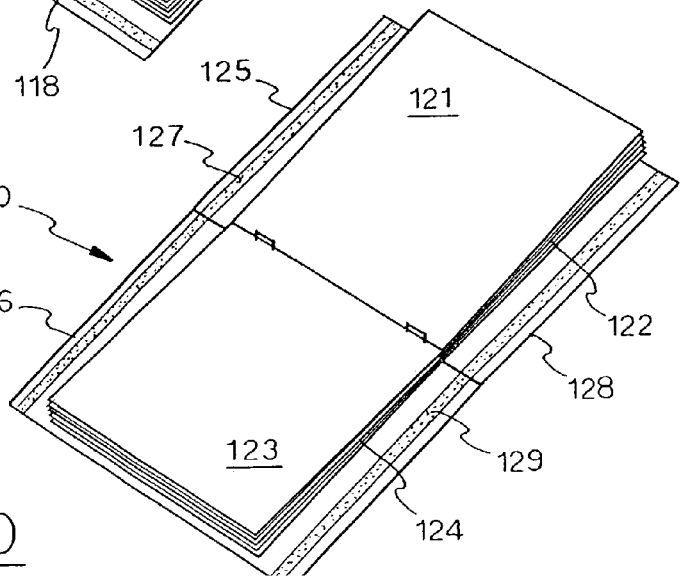
FIG. 10 is a plan view of an opened packet, containing an opened booklet, and which has two closed sides.

FIGS. 9 and 10 show two other wrapped booklet configurations as variations of the wrapped booklet packet 100 of FIG. 8.

FIG. 9 is a perspective view of an opened booklet packet 110, where the booklet sheets or, such as 111 and 113, have side edges 112 and 114 aligned with the side edges 119 of the outer wrap panels to provide a folded packet having two open side edges. The outer wrap panels 115 and 117 extend beyond the ends of the booklet sheets or and have releasable self seal contact adhesive strips 116 and 118. When the opposed adhesive strips are pressed together they adhere, closing the packet 110, to enclose the folded booklet. The use of two webs makes it possible to have a thick booklet with as many as thirteen sheets on each side of the fold line when thirty-six inch presses are used.

FIG. 10 shows an alternative configuration to the packet 110 of FIG. 9, it is a perspective view of an opened packet 120. The open center pages 121, 123 of the booklet 120 have their end edges flush with the ends of the outer wrap panels 125 and 126. The wrap panels 125 and 126 are wider than the booklet center pages 121 and 123 and their underlying pages. Along the side edges of the panels 125 and 126 there are releasable contact adhesive seal strips 126 and 127 along one side. And along the opposite side edge 128 there is a similar adhesive contact strip 129. Both adhesive strips are spaced from the insert side edges, such as 122 and 124, a sufficient distance to permit an overlap and closing of the wrap panel edges about the folded booklet. For a six by nine inch mailer, the width of the booklet panels would be about five inches.

In addition to the versatility of different configurations, and of different options of sealing the closed booklet, the combining of two separate webs, one for the outer wrap, and the other for the insert material, as noted previously, permits the use of different types of printed paper stocks, such as a high quality gloss for the insert material, and thicker paper stock for the wrap which can act as a cover.

Also, it should be noted that part of the wrap web is separated from the wrap ribbon and then subsequently added to the insert ribbons, so that a possibility of high gloss or heavy stock could be introduced, as well, as the center pages of the enclosed booklet.

Figure 11:
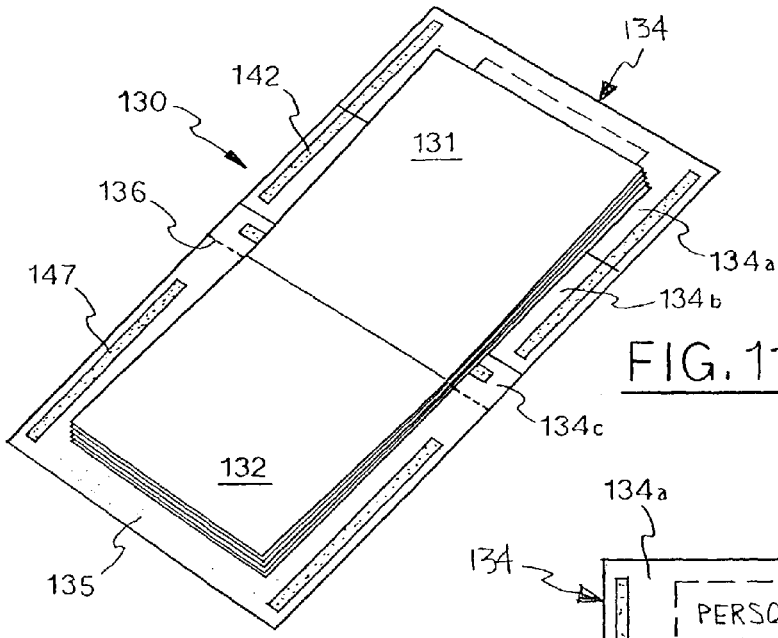
FIG. 11 is a plan view of a opened packet of folded sheets having an outer wrap which also is a return envelope.

FIG. 11 and related FIGS. 12 and 13 illustrate the ability to use the outer wrap panels for a return envelope by the recipient.

Referring to FIGS. 11 and 12, the return mailer packet 130 encloses superposed multiple sheet folded advertising pieces such as the center sheets 131 and 132. Center sheet 131 and its underlying sheets are disposed over the back panel 134 of the outer wrap which has two return envelope sections 134*a* and 134*b* and an envelope flap section 134*c*. Back panel 134 is the same size as the address panel 135. The half repeat fold line between the center sheets or pages 131 and 132, when it is folded, is aligned with the half repeat fold line 136 of the outer wrap.

FIG. 12 is a plan view of the inner surface of the outer wrap envelope repeat, showing the printing layout of the inner surface of the back panel return envelope. Subpanel sections 134*a* contains personalized data, such as a personal order form section 137. Subpanel 134*b* has an order form 138. Subpanels 134*a* and 134*b* are folded about line 139, as shown in FIG. 13, to form the envelope. The previously used self sealed releasable contact adhesive strips 142 and 143 are disposed along the inner side surface of the subpanels 134*a* and 134*b*, and can be reused. They fold on each other as indicated in FIG. 13 to adhere and hold the self addressed envelope panels 134*a* and 134*b* together to provide the envelope 140 as shown in FIG. 13. FIG. 13 is the partially folded back panel of the outer wrap, after it is detached along the perforated and folded half repeat line 136. The return envelope flap subpanel 134*c* has a strip of remoist glue 141 for sealing the return envelope after the flap is folded over along line 144.

The inner surface of the address panel 135 has personalized address data 145 and 146. Self seal, (such as latex) releasable contact, adhesive strips 147 and 148 are disposed along its side edges. They initially engage the adhesive strips 142 and 143 on the inside surface of the back panel to hold the address panel and the back panel of the packet together, when the entire packet is initially folded. The publication folder will fold both the insert material and the outer wrap panels about their aligned half repeat fold lines.

Opening of the packet to remove the insert material will not affect the ability of the adhesive strips 142 and 143 to subsequently adhere to each other in the return envelope.

Figure 14:
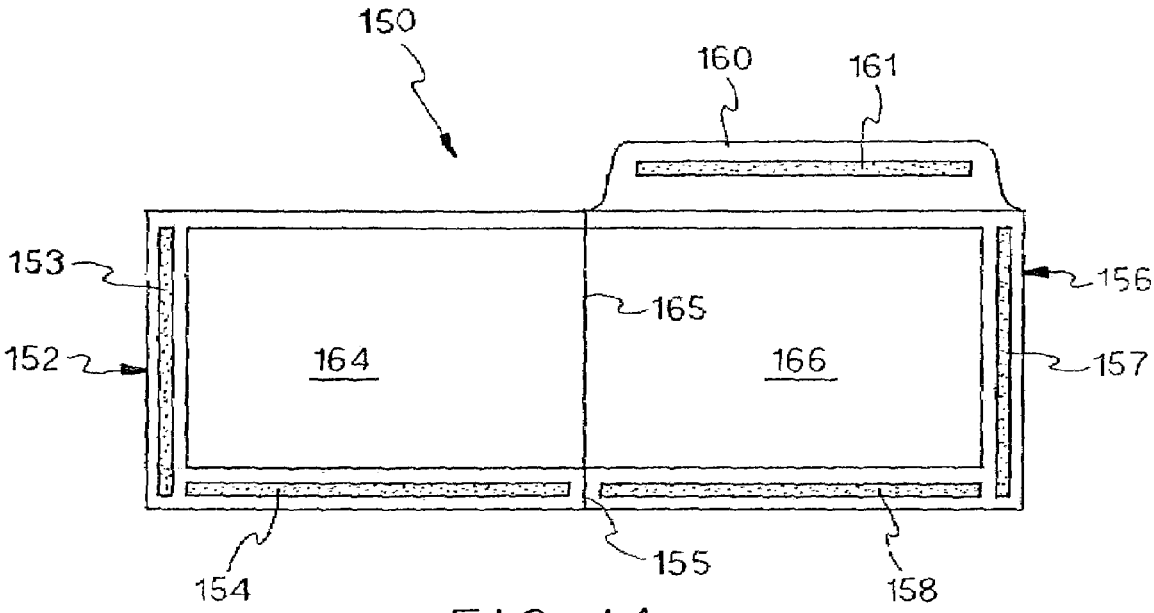
FIG. 14 is a plan view of a completed outer wrap blank for a fully enclosed envelope which is adapted to receive additional inserted material after complete fabrication of the packet.
Figure 15:
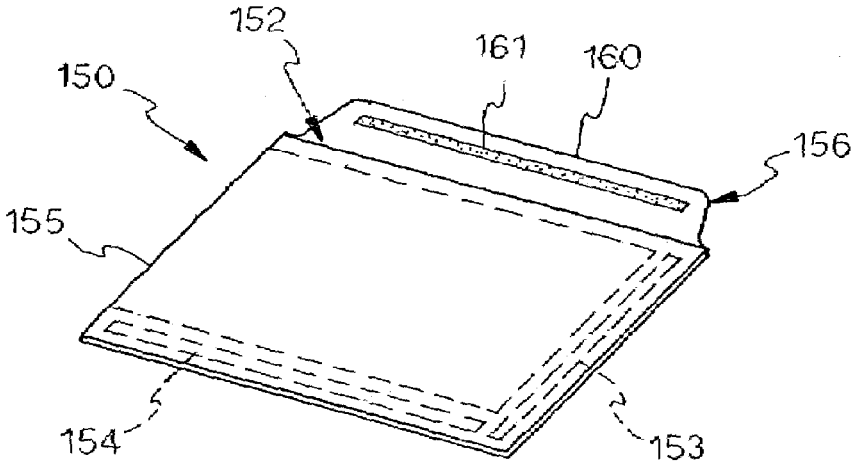
FIG. 15 is a perspective view of the outer wrap envelope format of FIG. 14 after complete manufacture of the packet.

FIGS. 14 and 15 show an open flap extra insert packet 150 for receiving samples or extra inserts. FIG. 14 is a plan view of the open packet 150 containing insert pages. Back panel 152, part of the outer wrap ribbon has a self seal adhesive such as a latex contact strip 153 at its free end and a side adhesive strip 154 along its lower side edge. The half repeat fold line 155 forms the inner edge of the front address panel 156. Address panel 156 has a strip of releasable contact seal adhesive 157, such as latex adhesive adjacent the outer side of panel 156. Contact adhesive strip 158 is disposed adjacent the lower side edge of the address panel 156. A closing flap 160 is disposed along the upper side edge of panel 156 and has a strip of remoist or self-seal glue 161, (applied at 67, FIG. 6) for sealing the envelope. Back panel 152 is folded over the address panel 156 along their common half repeat line 155.

The outer wrap encloses a multiple page insert having a plurality of multiple superposed sheets below the interior centerfold sheets 164 and 166. They are folded about their common half repeat fold line 165.

FIG. 15 is a perspective view of the folded packet 150 showing the open envelope after folding, and the outwardly extending flap 160. The back and address panels from the outer wrap, forms an open envelope with one end being the fold line along the common repeat lines 155 and 165, and the other end being the adhesively closed opposite end of the packet. The panels are held by the interaction of the matching contact adhesive seal strips 153 and 157, when they are brought into contact with each other. The lower side edge of the envelope is closed by the interaction of the matching adhesive strips 154 and 158.

This packet 150 configuration is designed in an open envelope configuration to permit receiving additional samples or inserts after the packet is formed, by the inline crossfold assembly. The outer wrap ribbon is initially wider than the envelope width. The outer wrap ribbon is of sufficient width to include the width of the rectangular envelope panels and the closing flap 160. Remoist glue is applied to the outer wrap ribbon for flap 160 before it is die cut, at 67 of FIG. 6, to provide prior, to die-cutting, the closing flap 160.

The stacked opened packets 150 are then subsequently filled with a sample or other material, by a separate operation in a conventional mechanical stuffing operation.

Figure 16:
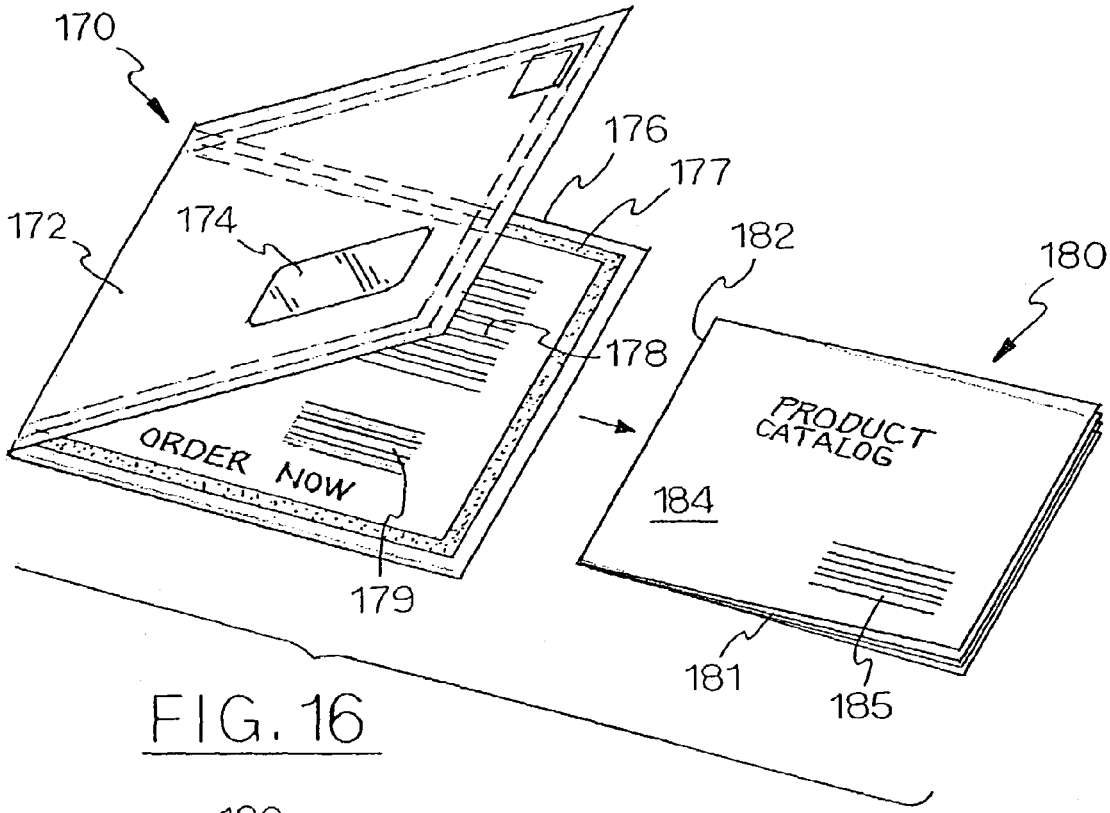
FIG. 16 is an exploded perspective view of a packet showing an outer wrap usable as an order and return envelope piece and having an address window.

FIG. 16 illustrates a unique arrangement for the outer wrap generally indicated in 170. The front address panel 172 has a cutout window section 174. The window would be die cut as part of the inline processing. The address panel is joined at one end along the half repeat and fold line 175, to rear outer wrap panel 176. A strip of self seal releaseable contact adhesive 177, usually latex adhesive, is disposed along the rear panel outer edges, and complements a corresponding contact adhesive strip, on the corresponding inner outer edge surface of the front address panel 172.

The rear panel has printed order blank material 178 to be used by the addressee as a return envelope. The return address of the distributor is printed at 179 on the rear panel 176. The return address 179 is aligned with the cutout window opening 174 on the address panel, so that the return address will show through it after the insert material is removed.

A folded multi-sheet product catalog, insert generally indicated at 180, has a plurality of sheets 181 folded along the fold line 182. The product catalog 180, when folded within the outer wrap, by folder assembly 82, 83, fits into the outer wrap envelope 170. The fold line 182 is being in contact with the interior surface of outer wrap fold line 175.

The periphery of the product catalog is within and immediately adjacent to the contact envelope panel adhesive strips such as strip 177 of the back panel 176. The address section 185 on the front page of the product catalog 180 is aligned with the cutout window opening 174 of panel 172. In this manner, the product catalog will have the address of the addressee for mailing. Consequently, the outer wrap 170 uniquely functions as both an initial mailing envelope, as well as a convenient, return envelope where both addresses are preprinted. The reusable adhesive permits the panels to be separated for removal of the product catalog 180, and also allows the addressee to fill in the order information on the rear panel 178. The front and rear panels are then brought into contact and held together by the self seal reusable contact adhesive, such as latex. The senders return address 179 will show through the cutout window section 174 of the front address panel 172. Both the outer wrap 170, and the product catalog 180 are simultaneously folded by the folder unit.

Figure 17:
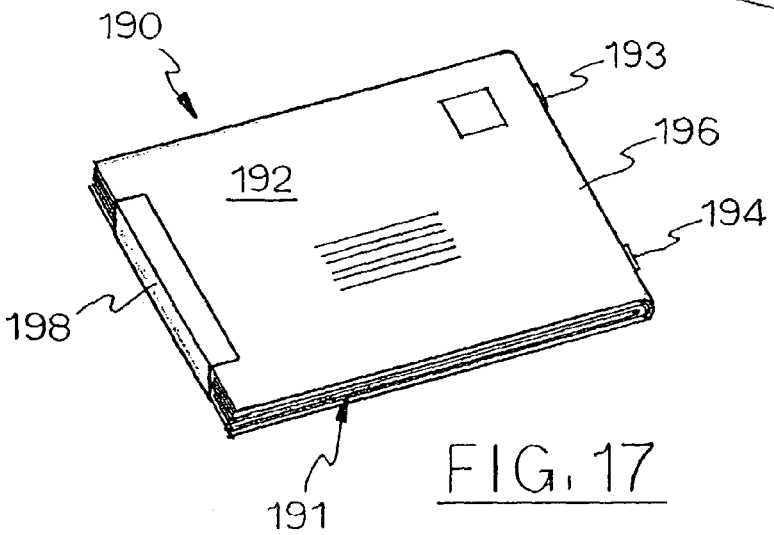
FIG. 17 is a perspective view of an elongated multi-page packet and outer wrap, joined in a multi-page booklet configuration.

FIG. 17 shows in perspective another type of envelope-booklet assembly, generally indicated at 190. A folded booklet 191 is enclosed by an outer wrap having a front address panel 192 joined to an underlying back outer wrap envelope panel, not shown. The outer wrap envelope panels are of heavier stock. High gloss finish and high quality printing enables the panels to serve as front and back cover sheets for the catalog 191. The outer panels and the catalog sheets are the same size. Staples 193, 194 pass through both cover and catalog along their aligned half-repeat fold lines. The catalog is held in a closed position along its folded end by elongated wafer glue seal member 198.

Figure 18:
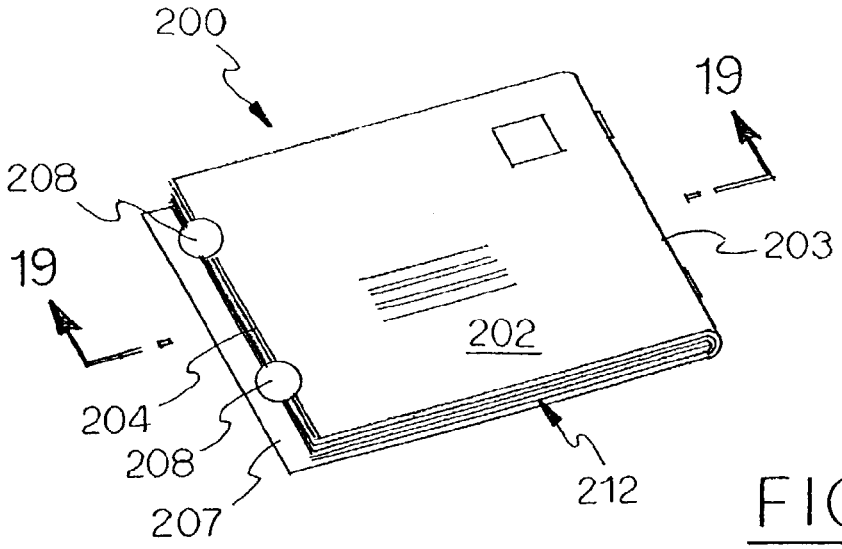
FIG. 18 is a perspective view of a packet and multi-page booklet folded at one end and closed at the opposite end by an applied wafer seal element.
Figure 19:
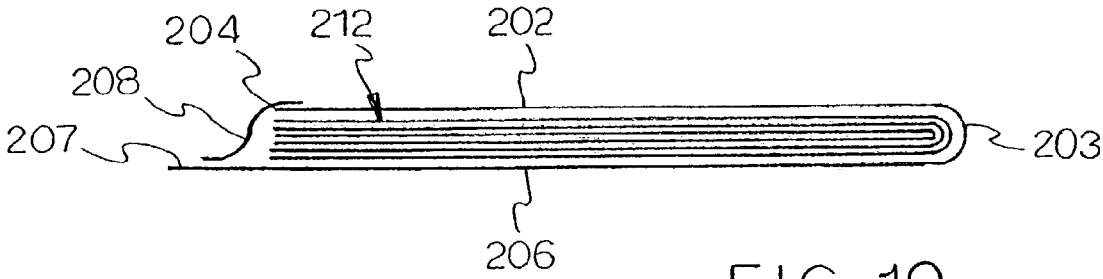
FIG. 19 is a cross sectional view of the packet of FIG. 18 along lines 19—19.

FIGS. 18 and 19 show a seal arrangement for a booklet-catalog and cover arrangement of the type of FIG. 17, when the booklet-catalog is very thick. The cover type booklet-catalog generally indicated at 200, has an outer cover address and stamp cover address panel 202 having a closed fold end 203 and an open closing end 204. The back cover panel 206 as shown in FIG. 19, is joined along the fold line 203 to the address panel 202. The seal end 207 extends outwardly beyond the end 204 of panel 202. Two paper seal members 208 are applied to the upper surfaces of the cover panels 202 and 206, at their respective edges 204 and 207 to close the catalog for shipping.

Figure 20:
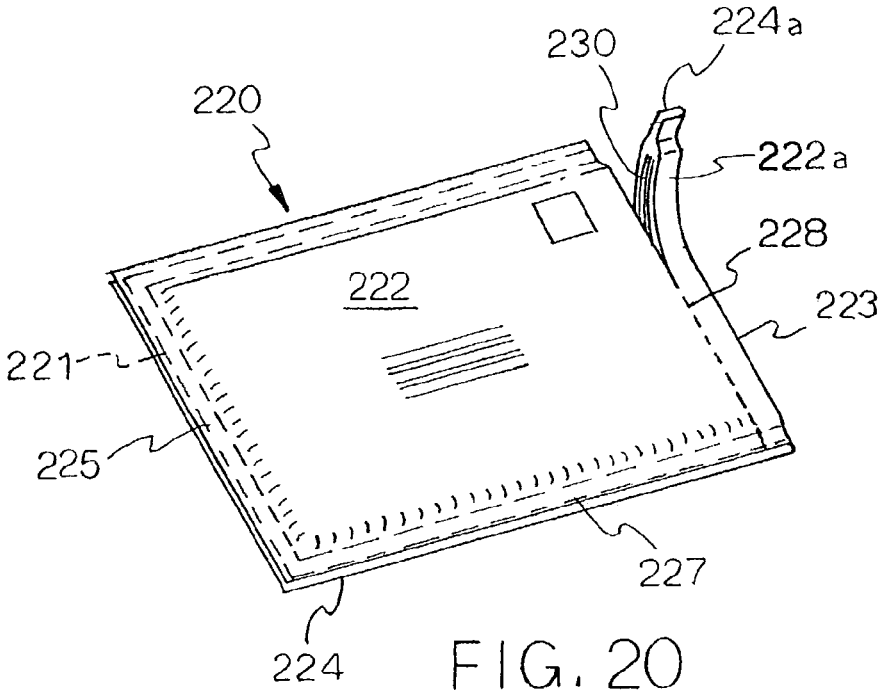
FIG. 20 is a perspective view of a packet openable by tearing off the folded end along a perforated line and which provides multiple separate pieces.

FIG. 20 is a perspective view of a packet configuration for a relatively thin mailer packet having multiple single sheet advertising or coupon pieces. The mailer has a rectangular address panel 222 joined along a fold line 223 to the back envelope panel 224 at one end. The opposite end 225 of the packet and the sides of the packet 227 are held together by a continuous strip of self seal releasable adhesive 226 which extends around the periphery of the packet. Disposed within the packet is a relatively small number of advertising or coupon inserts which were simultaneously folded adjacent and within the fold line 223 by the publication folder. The perforate line 228, extending parallel and slightly spaced from the fold line 223, extends across the envelope from side to side and completely pierces the envelope itself. A section of the address panel **222*a* and a back envelope panel 224*a* form a tear strip which can be torn from the envelope to remove the fold line section 223 of the envelope panels as well as the fold line sections 230 of the folded insert sheets. The perforation line 228** is sufficient to enable the removal of the folded sections of both the envelope panels and the folded insert sheets without difficulty. When the tear off section is removed to open the packet, the folded advertising insert or coupon material is converted to a series of individual single sheet pieces.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. An inline produced advertising packet, comprising:

a) two superposed and spaced rectangular outer wrap envelope panels each taken from one of two adjacent half repeat sections of an inline printed common repeat on a first web, b) each of one of the panels from the first web being the length of half repeat sections and being joined to each other at an end along a common half repeat line between them, c) a plurality of insert paper sheets being disposed between and within the periphery of the two rectangular outer wrap envelope panels, occupying in common the printed common repeat of the two rectangular outer wrap envelope panels, and the plurality of insert paper sheets being taken from the first web;

d) the plurality of insert paper sheets from the first web being disposed adjacent to each other and substantially free of adhesive, and being disposed adjacent to and within the two rectangular outer wrap envelope panels and substantially free of adhesive, e) additional rectangular insert paper sheets from a second web being provided;

f) the additional rectangular insert paper sheets from the second web being disposed adjacent to the plurality of insert paper sheets from the first web and substantially free of adhesive, and adjacent to and between the two rectangular outer wrap envelope panels from the first web and substantially free of adhesive, g) at least one side of each of the two rectangular outer wrap envelope panels extending beyond an edge of a corresponding side of the insert paper sheets from the first web and each defining a respective gripping section, and h) each extended envelope panel having a self sealing releasable contact adhesive on the inner surface of an adjacent side edge and being located between each respective gripping section to hold the envelope panel edges together.

2. The inline packet of claim 1, wherein:

a) the two superposed rectangular outer wrap envelope panels are joined along a common end which also is a fold line and is configured as their half repeat line;

b) the insert sheets are joined together along an adjacent common side which is configured as their half repeat line; and c) a fold line is provided on the insert sheets, the fold line of their adjacent superposed rectangular outer wrap envelope panels is adjacent to and is in contact with the fold line of the insert sheets, and the two superposed rectangular outer wrap envelope panels enclose the insert paper sheets and the additional rectangular insert paper sheets when the inline produced advertising packet is produced inline.

3. The inline packet of claim 2, wherein:

a) an outermost folded printed insert sheet has a strip of contact adhesive on its fold line contact with an adjacent printed piece along its fold line; and b) all of the printed insert sheets except the outermost printed piece are stapled together at their common fold line to form a multiple page booklet.

4. The inline packet of claim 1, wherein:

a) the self sealing releasable contact adhesive is sufficiently spaced from outer edges of the envelope panels to permit the outer edges to be used to pull the envelope panels.

5. The inline packet of claim 1, wherein:

a) the envelope panels are perforated between the adhesive and the insert sheets to permit the outer edge section with the adhesive to be torn from the envelope panels to open the packet.

6. The inline packet of claim 1, wherein:

a) one of the envelope panels has a printed mailing address of a specific addressee; and, b) at least one of the insert sheets also has printed personalized data relating to that specific addressee.

7. The inline packet of claim 1, wherein:

a) a common fold line is provided on the insert sheets, and the insert sheets are fastened together at their common fold line to form a multiple page booklet.

8. The inline packet of claim 1, wherein:

a) the insert sheets are printed insert sheets, and the side edges of the printed insert sheets are inwardly spaced from the side edges of the envelope panels; and b) a further self sealing releasable contact adhesive is disposed on the inside surfaces of the outer wrap envelope panels between the side edges of the envelope panels and the side edges of the printed insert sheets.

9. The inline produced packet of claim 1, wherein:

a) the inner surface of one of the outer wrap envelope panels has two printed return envelope panels and a sealing flap which permit it to be reused as a return envelope.

10. The inline produced packet of claim 9, wherein:

a) the outer wrap panels have a long side width, and a self sealed reusable contact adhesive on their inner surface adjacent their side edges to hold the outer wrap panels together;

b) the inner surface of the one envelope panel having return envelope panels contains printed order form material, and c) the panels can be refolded over each other by the sender and held together at their side edges by the self sealed releasable contact adhesive on the envelope panel.

11. The inline produced packet of claim 10, wherein:

a) a return envelope closing flap is disposed adjacent and parallel to one of the return panels and has remoist adhesive on its surface for sealing the return envelope.

12. The inline produced packet of claim 11, wherein:

a) a transverse perforate line extended across the outer wrap adjacent to the return envelope closing flap permit it to be detached by an addressee.

13. The inline produced packet of claim 11, wherein:

a) the outer surface of an outer wrap envelope panel and the return envelope each have corresponding personalized printing.

14. The inline packet of claim 1, wherein:

a) one of the envelope panels has a printed mailing address of a specific addressee.

* * * * *